US005880087A

United States Patent [19]

Zack et al.

[11] Patent Number: 5,880,087

[45] Date of Patent: Mar. 9, 1999

[54] RINSE AND COMPOSITIONS CONTAINING ALKYLIMINODIALKANOATES

[76] Inventors: Kenneth L. Zack, 1252 Walnut, Wyandotte, Mich. 48192; Michael C. Welch, 22432 Old Mill Ct., Woodhaven, Mich. 48183; Glenis Roberts, 3454 17th St., Wyandotte, Mich. 48192

[21] Appl. No.: 781,969

[22] Filed: Dec. 28, 1996

[51] Int. Cl.[6] ..... C11D 1/04; C11D 3/37

[52] U.S. Cl. ..... 510/514; 510/499

[58] Field of Search ..... 510/499, 514

[56] References Cited

U.S. PATENT DOCUMENTS

| | | | |
|---|---|---|---|
| 4,203,872 | 5/1980 | Flanagan | 510/182 |
| 4,264,479 | 4/1981 | Flanagan | 510/182 |
| 4,416,794 | 11/1983 | Barrat et al. | 510/514 |
| 4,443,270 | 4/1984 | Biard et al. | 134/25.2 |
| 4,539,144 | 9/1985 | De Ridder et al. | 510/230 |
| 4,678,596 | 7/1987 | Dupre et al. | 510/514 |
| 5,273,677 | 12/1993 | Arif | 510/514 |
| 5,516,452 | 5/1996 | Welch et al. | 510/514 |
| 5,540,864 | 7/1996 | Michael | 510/499 |

FOREIGN PATENT DOCUMENTS

| | | |
|---|---|---|
| 0 308 221 B1 | 4/1992 | European Pat. Off. . |

OTHER PUBLICATIONS

Chemical Abstract 106:86743 "Low–foaming alkali detergents", Tomooka et al., Aug. 1986.

*Primary Examiner*—Ellen M. McAvoy
*Attorney, Agent, or Firm*—Joanne P. Will

[57] ABSTRACT

An improved rinse aid composition comprising a blend of nonionic low foam surfactants, hydrotropes, polycarboxylate polymers and alkyliminodialkanoates.

4 Claims, No Drawings

RINSE AND COMPOSITIONS CONTAINING ALKYLIMINODIALKANOATES

FIELD OF THE INVENTION

This invention relates to stable rinse aid compositions containing certain low foam nonionic surfactants, a polymer of acrylic acid and an alkyliminodialkanoate. Further, the invention relates to a method for improving the stability of a rinse aid composition containing a low foam nonionic surfactant and a polymer of acrylic acid by adding an alkyliminodialkanoate.

BACKGROUND OF THE INVENTION

Rinse aid formulations generally are aqueous solutions containing nonionic surfactants which promote rapid draining of water from dishware and minimize spotting-and-filming. Under conditions of high total dissolved solids, surfactants alone will not prevent filming. It is known that polymers of acrylic acid can improve the performance of rinse aid compositions by inhibiting deposition of mineral salts which contribute to filming of dishware.

EP0308221B1 discloses a rinse aid composition containing a low foam nonionic surfactant, an acrylic acid polymer of molecular weight 1000 to 250,000, and an additional nonionic surfactant having a cloud point of at least 70° C. to serve as a stabilizer. U.S. Pat. No. 4,678,596 discloses a rinse aid composition containing a low foam nonionic surfactant, a low molecular weight poly(meth)acrylic acid, and a high molecular weight stabilizing polymer of methacrylic acid.

Finally, U.S. Pat. No. 4,203,872 and U.S. Pat. No. 4,264,479 disclose surfactant compositions comprising (a) 25–75% nonionic surfactant, (b) 5–65% amphoteric detergent such as an alkylaminodipropionate, (c) 8–50% quaternary ammonium halide, (d)water. Said compositions are useful in preparing cleaners and degreasers, glass and smooth surface cleaners, wax and floor finish strippers, and soap film removers.

Applicants have now surprisingly discovered that the addition of certain alkyl iminodipropionates stabilizes rinse aid compositions without the need for a high cloud point nonionic surfactant or compatibilizing polymer for stability.

SUMMARY

The present invention relates to a rinse aid composition comprising:

(a) 5 to 95% of low foaming nonionic surfactants;

(b) 0.1 to 90% hydrotropes;

(c) 0.1 to 10% polycarboxylate polymers;

(d) 0.1 to 15% alkyliminodialkanoates having the following structure:

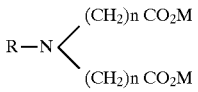

wherein n=0–10, M=H, Na, or K; R=straight or branched, saturated or unsaturated, aliphatic hydrocarbon group having about 1–18 carbon atoms, such as lauryl, tridecyl, pentadecyl, palmityl, tallow, coco, soya, and linoleyl and mixtures thereof.

The present invention also relates to a method for reducing spotting and filming in dishware, comprising contacting said dishware with a rinse aid composition comprising:

(a) 5 to 95% of low foaming nonionic surfactants;

(b) 0.1 to 90% hydrotropes;

(c) 0.1 to 10% polycarboxylate polymers;

(d) 0.1 to 15% alkyl iminodialkanoates having the following structure:

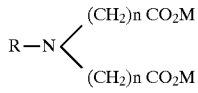

wherein n=0–10, M=H, Na, or K; R=straight or branched, saturated or unsaturated, aliphatic hydrocarbon group having about 1–18 carbon atoms, such as lauryl, tridecyl, pentadecyl, palmityl, tallow, coco, soya, and linoleyl and mixtures thereof.

DETAILED DESCRIPTION

The present invention relates to a rinse aid composition comprising:

(a) 5 to 95% of low foaming nonionic surfactants;

(b) 0.1 to 90% hydrotropes;

(c) 0.1 to 10% polycarboxylate polymers;

(d) 0.1 to 15% alkyl iminodialkanoates having the following structure:

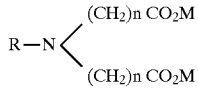

wherein n=0–10, M=H, Na, or K; R=straight or branched, saturated or unsaturated, aliphatic hydrocarbon group having about 1–18 carbon atoms, such as lauryl, tridecyl, pentadecyl, palmityl, tallow, coco, soya, and linoleyl and mixtures thereof.

The present invention also relates to a method for reducing spotting and filming in dishware, comprising contacting said dishware with a rinse aid composition comprising:

(a) 5 to 95% of low foaming nonionic surfactants;

(b) 0.1 to 90% hydrotropes;

(c) 0.1 to 10% polycarboxylate polymers;

(d) 0.1 to 15% alkyl iminodialkanoates having the following structure:

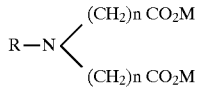

wherein n=0–10, M=H, Na, or K; R=straight or branched, saturated or unsaturated, aliphatic hydrocarbon group having about 1–18 carbon atoms, such as lauryl, tridecyl, pentadecyl, palmityl, tallow, coco, soya, and linoleyl.

Preparing the Rinse Aid Compositions of the Present Invention

The rinse aids of the present invention are prepared by blending hydrotropes, low foam nonionic surfactants, polycarboxylate polymers and alkyliminodialkanoates according to methods known to those skilled in the art.

HYDROTROPES

The compositions of the present invention contain hydrotropes. Hydrotropes useful in the present invention include, but are not limited to, sodium xylene sulfonate, sodium cumene sulfonate, hexylene glycol, propylene glycol, dihexyl sodium sulfonate, and short chain alkyl sulfates. U.S. Pat. No. 3,563,901 and U.S. Pat. No. 4,443,270 disclose useful hydrotropes and are incorporated by reference herein. Dihexyl sodium sulfosuccinate is a particularly preferred hydrotrope. Hydrotropes are present at a level of 0.1 to 90% by weight, preferably at a level of 1 to 80% by weight and most preferably at a level of 10 to 60% by weight.

SURFACTANTS

Low Foaming Nonionic Surfactants

The rinse aid compositions of the present invention contain low foaming nonionic surfactants at levels of about 5 to 95% by weight, preferably about 5 to 60% by weight; most preferably about 10 to 40% by weight. Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow fatty acids (derived from tallow-class fats) which contain an average of about 18 carbon atoms, palmitic acid, myristic acid, stearic acid and lauric acid.

(b) polyoxyalkylene (polyoxyethylene or polyoxypropylene) condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. INDUSTROL® DW5 surfactant is a preferred condensate of an aliphatic alcohol. INDUSTROL® DW5 surfactant is available from BASF Corporation, Mt. Olive, N.J.

(c) polyoxyalkylene (polyoxyethylene or polyoxypropylene) condensates of alkyl phenols, whether linear- or branched-chain and unsaturated or saturated, containing from about 6 to about 12 carbon atoms and incorporating from about 5 to about 25 moles of ethylene oxide or propylene oxide.

(d) Particularly preferred nonionic surfactants are selected polyalkylene oxide block copolymers. This class can include polyethoxylated polypropoxylated propylene glycol sold under the tradename "PLURONIC®" made by the BASF Corporation or polypropoxylated-polyethoxylated ethylene glycol sold under the tradename "PLURONIC-R®" made by the BASF Corporation, Mt. Olive, N.J. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called "PLURONIC-R®" are formed by condensing propylene oxide with the polyethoxylated ethylene glycol condensate. This series of compounds is characterized by having an average molecular weight of about between 2000 and 9000 consisting of, by weight, from about 10 to 80 percent polyoxyethylene, and a polyoxypropylene portion having a molecular weight between about 1000 and 3100.

U.S. Pat. No. 4,366,326; 4,624,803; 4,280,919; 4,340,766; 3,956,401; 5,200,236; 5,425,894; 5,294,365; incorporated by reference herein, describe in detail nonionic surfactants useful in the practice of this invention.

Finally, *Surfactant Science Series*, edited by Martin J. Schick, nonionic Surfactants, Vols. 19 and 23 provide detailed description of nonionic surfactants and are incorporated by reference herein.

Other Surfactants Useful in the Compositions of the Present Invention

The rinse aid compositions herein may also contain surfactants selected from the group of organic surfactants consisting of anionic, cationic, zwitterionic and amphoteric surfactants, and mixtures thereof. Said other surfactants are present at a level of about 0 to 100% by weight, preferably about 1 to 80% by weight, most preferably, about 5 to 60% by weight. Surfactants useful herein are listed in U.S. Pat. No. 4,396,520 Payne et al., issued Aug. 2, 1983. U.S. Pat. No. 3,664,961, Norris, issued May 23, 1972 and in U.S. Pat. No. 3,919,678, Laughlin et al. issued Dec. 30, 1975, each of which is incorporated herein by reference. Useful cationic surfactants also include those described in U.S. Pat. No. 4,222,905, Cockrell, issued Sep. 16, 1980, and U.S. Pat. No. 4,239,659, Murphy, issued Dec. 16, 1980, both incorporated herein by reference.

Useful anionic surfactants include the water-soluble salts, preferably the alkali metal, ammonium and substituted ammonium salts, of organic sulfuric acid reaction products having in their molecular structure of alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzenesulfonates in which the alkyl group contains from about 9 to about 15 carbon atoms in straight chain or branched chain configuration, e.g., those of the type described in U.S. Pat. Nos. 2,220,099 and 2,477,383 both of which are incorporated herein by reference. Especially valuable are linear straight chain alkylbenzene sulfonates in which the average number of carbon atoms in the alkyl group is from 11 to 13, abbreviated as $C_{11-13}$LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and from about 8 to about 12 carbon atoms in the alkyl group; and sodium or potassium salts of alkyl ethylene oxide ether sulfates containing from about 1 to about 25 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 9 to about 23 carbon atoms in the alkyl group and from about 8 to 20 carbon atoms in the moiety.

Particularly preferred surfactants herein are anionic surfactants selected from the group consisting of the alkali metal salts of $C_{11-13}$ alkylbenzene sulfonates, $C_{12-18}$ alkyl sulfates, $C_{12-18}$ alkyl linear polyethoxy sulfates containing from about 1 to about 10 moles of ethylene oxide, and mixtures thereof and nonionic surfactants that are the condensation products of alcohols having an alkyl group containing from about 9 to about 15 carbon atoms with from about 4 to about 12 moles of ethylene oxide per mole of alcohol.

Cationic surfactants, useful in the practice of the present invention, comprise a wide variety of compounds characterized by one or more organic hydrophobic groups in the cation and generally by a quaternary nitrogen associated with acid radical. Quaternary nitrogen compounds also include nitrogen-containing ring compounds. Suitable anions are halides, methyl sulfate and hydroxide. Tertiary amines can have characteristics similar to cationic surfactants at washing solutions with pH values less than about 8.5.

A more complete disclosure of cationic surfactants can be found in U.S. Pat. No. 4,228,044, issued Oct. 14, 1980, to Cambre, said patent being incorporated herein by reference.

Amphoteric surfactants, useful in the practice of the present invention, include derivatives of heterocyclic secondary and tertiary amines in which the aliphatic moiety can be straight chain or branched, and wherein one of the aliphatic substituents contains from about 8 to 18 carbon atoms and at least one aliphatic substituent contains an anionic water-solubilizing group.

POLYCARBOXYLATE POLYMERS

The rinse aid compositions of the present invention also contain polycarboxylate polymers having a molecular weight of about 500–350,000 represented by the following formula:

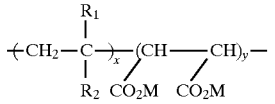

wherein $R_1$=H or $CH_3$: $R_2$=$CO_2M$; M=H or alkali metal; x=7–1500; y=0–1000.

The polycarboxylates comprise homopolymers or copolymers of acrylic acid, methacrylic acid, maleic acid, fumaric acid, itaconic acid, and the like. They may be polyacrylic acid, polymethacrylic acid, or a copolymer of acrylic and methacrylic acids, said homopolymer or copolymer may range in molecular weight from about 500 up to about 350,000 depending on the degree of crosslinking.

While the preparation of polyacrylates from acrylic acid and methacrylic acid monomers is well known in the art and need not be detailed here, the following will illustrate the general technique that can be used.

The polymerization of acrylic acid to polyacrylate acid can be stopped at any appropriate molecular weight (determined by viscosity). The conditions under which it is polymerized will result in different performance characteristics for similar molecular weight polymers. If, for example, the polymerization took place under a condition of a high temperature (100°–150° C.), there will be a strong tendency for crosslinking to occur. Crosslinking is undesirable as it decreases the apparent acid strength of the polyacid by preventing the expansion of the molecules, which would otherwise increase the separation between carboxylic groups. This results in two distinct adverse effects. First, the solubility of the polymer is reduced and, second, the chelation ability is reduced. It should be noted that the higher the molecular weight, the more likely extensive crosslinking occurs. It is, however, possible to produce polyacrylic acid having molecular weights in the millions without extensive crosslinking by reacting the monomers under very mild conditions.

Water soluble salts of acrylic acid and methacrylic acid homopolymers as described above are especially preferred for the purposes of the invention. The water soluble salt can be an alkali metal, ammonium or substituted (quaternary) ammonium salt. The alkali metal can be sodium or potassium. The sodium is preferred. The salt can be used in a partially or fully neutralized form. Also, partial neutralization and esterification of the carboxylic acid groups can be carried out while still retaining the effective properties of the homopolymer. The homopolymers are converted to the desired salt by reaction with the appropriate base, generally with a stoichiometric excess of the desired percent of conversion. Normally 100 percent of the carboxyl groups present will be converted to the salt, but the percentage can be less in certain situations.

A preferred water soluble polycarboxylate polymer useful in the present invention is a sodium salt of polyacrylic acid, having a molecular weight of about 500–350,000; more preferably about 500–70,000; most preferably about 1,000 to 20,000, even more preferably about 1,000 to 10,000. The polycarboxylate polymers are used uiat levels of 0.1–10% by weight; preferably 0.1–8% by weight; most preferably 1–6% by weight.

Alkyl Iminodialkanoates

Finally, the rinse aid compositions of the present invention contain alkyliminodialkanoates having the following formula:

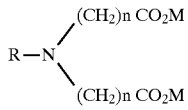

wherein n=0–10, M=H, Na, or K; R=straight or branched, saturated or unsaturated, aliphatic hydrocarbon group having about 1–18 carbon atoms, such as lauryl, tridecyl, pentadecyl, palmityl, tallow, coco, soya, and linoleyl and mixtures thereof. The preferred alkyl iminodialkanoate is:

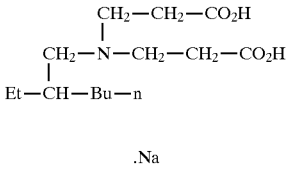

.Na

Beta-alanine, N-(2-carboxyethyl)-N-(2-ethylhexyl)-, monosodium salt (i.e. alkylimindipropionate)

Preferably, the range of alkyliminodialkanoates is 0.1–20% by weight, more preferably 1–15% by weight and most preferably 2–10% by weight.

The following Examples further describe and demonstrate the present invention. The Examples are given solely for the purpose of illustration, and are not to be construed as limitations of the present invention.

| Testing of the Rinse Aid Compositions of the Present Invention | |
|---|---|
| Detergent composiion: | |
| 34% | sodium tripolyphosphate |
| 18% | sodium carbonate |
| 25.5% | sodium metasilicate pentahydrate |
| 15% | caustic soda |
| 2.5% | chlorinated isocyanurate |
| 5% | water |
| Soil: | |
| 80% | margarine |
| 20% | powdered milk |

Five glasses were evaluated after five wash/rinse cycles in a Hobart AM-11 dishwasher, using 1000 ppm total dissolved solids water containing 30% sodium sulfate, 30% sodium chloride, 40% sodium bicarbonate by weight.

Cycle 1: 163.5 grams detergent, 40 grams soil.

Cycle 2: 13.6 grams detergent, 40 grams soil.

Cycle 3: repeat Cycle 2.

Cycle 4: repeat Cycle 3.

Cycle 5: repeat Cycle 4.

The glasses were visually rated on a scale of from one (spot and film free) to five (complete coverage spots and film).

EXAMPLE 1

A rinse aid composition of 10% by weight of a 3100 molecular weight block copolymer of ethylene oxide and propylene oxide, 30% by weight sodium xylene sulfonate hydrotrope, and 60% by weight deionized water.

The rinse aid is injected at a rate such that the final rinse water contains 400 ppm rinse aid.

EXAMPLE 2

A rinse aid composition of 10% by weight of a 3100 molecular weight block copolymer of ethylene oxide and propylene oxide, 30% percent by weight sodium xylene sulfonate, 2% percent by weight of a partially neutralized 8000 molecular weight polymer of acrylic acid, and 58% by weight deionized water.

The rinse aid is injected at a rate such that the final rinse water contains 400 ppm rinse aid.

EXAMPLE 3 (the present invention)

A rinse aid composition of 10% by weight of a 3100 molecular weight block copolymer of ethylene oxide and propylene oxide, 30% by weight sodium xylene sulfonate hydrotrope, 2% by weight of a partially neutralized 8000 molecular weight polymer of acrylic acid, 8% by weight of an alkyl iminodipropionate and 50% by weight deionized water.

The rinse aid is injected at a rate such that the final rinse water contains 400 ppm rinse aid.

Table 1 serves to illustrate the superior benefits of the present invention over the prior art.

TABLE 1

| Example | Appearance | Spotting & Filming |
|---|---|---|
| 1 | Clear | 4.5 |
| 2 | Cloudy | 2.7 |
| 3 | Clear | 2.9 |

In conclusion, the rinse aid composition of the present invention (Example #3) is effective at minimizing the spotting-and-filming of glassware under high total dissolved solids conditiona and do not require additional high cloud point nonionic surfactants and/or polymers to provide stability.

We claim:

1. A rinse aid composition consisting essentially of:

(a) 5 to 95% of low foaming nonionic surfactants;

(b) 0.1 to 90% hydrotropes;

(c) 0.1 to 10% Polycarboxylate polymers;

(d) 0.1 to 15% alkyliminodialkanoates having the following structure:

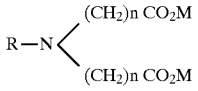

wherein n=0–10, M=H, Na, or K; R=straight or branched, saturated or unsaturated, aliphatic hydrocarbon group having 1–18 carbon atoms selected from the group consisting of lauryl, tridecyl, pentadecyl, palmityl, tallow, coco, soya, and linoleyl.

2. A rinse aid composition according to claim 1, wherein said alkylimino dialkanoate is beta-alanine, N-(2-carboxy ethyl)-N-(2-ethyl hexyl)-monosodium salt.

3. A method of reducing spotting and filming of dishware comprising contacting said dishware with a rinse aid composition consisting essentially of:

(a) 5 to 95% of low foaming nonionic surfactants;

(b) 0.1 to 90% hydrotropes;

(c) 0.1 to 10% Polycarboxylate polymers;

(d) 0.1 to 15% alkyl iminodialkanoates having the following structure:

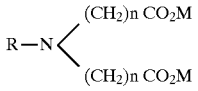

wherein n=0–10, M=H, Na, or K; R=straight or branched, saturated or unsaturated, aliphatic hydrocarbon group having 1–18 carbon atoms selected from the group consisting of lauryl, tridecyl, pentadecyl, palmityl, tallow, coco, soya, and linoleyl.

4. A method according to claim 3, where said alkyliminodialkanoate is beta-alamine, N-(2-carboxy ethyl)-N-(2-ethyl hexyl)-monosodium salt.

* * * * *